US009033829B2

(12) United States Patent
Capicchioni

(10) Patent No.: US 9,033,829 B2
(45) Date of Patent: May 19, 2015

(54) GOAL-KEEPING GAME

(71) Applicant: Virginia Capicchioni, Oradell, NJ (US)

(72) Inventor: Virginia Capicchioni, Oradell, NJ (US)

( * ) Notice: Subject to any disclaimer, the term of this patent is extended or adjusted under 35 U.S.C. 154(b) by 214 days.

(21) Appl. No.: 13/936,861

(22) Filed: Jul. 8, 2013

(65) Prior Publication Data

US 2015/0018133 A1 Jan. 15, 2015

(51) Int. Cl.
*A63B 67/00* (2006.01)
*A63B 63/00* (2006.01)

(52) U.S. Cl.
CPC ..... *A63B 67/00* (2013.01); *A63B 63/004* (2013.01)

(58) Field of Classification Search
USPC ..... 473/446, 470, 471, 422, 438, 476–478; 434/251
See application file for complete search history.

(56) References Cited

U.S. PATENT DOCUMENTS

| | | | | |
|---|---|---|---|---|
| 3,746,340 | A * | 7/1973 | Ellis | 473/471 |
| 4,203,594 | A * | 5/1980 | Cagle | 473/471 |
| 5,207,433 | A * | 5/1993 | Moore | 473/470 |
| 5,669,833 | A * | 9/1997 | Stone | 473/422 |
| 7,156,762 | B1 * | 1/2007 | Rondinelli | 473/472 |
| 7,670,237 | B2 * | 3/2010 | Wagner | 473/446 |
| 8,277,342 | B2 | 10/2012 | Bucalo | |
| 8,435,142 | B2 * | 5/2013 | Gibson | 473/471 |
| 2004/0121863 | A1 * | 6/2004 | Liberfarb | 473/470 |
| 2006/0189416 | A1 | 8/2006 | Nelson | |
| 2007/0021241 | A1 * | 1/2007 | Geller et al. | 473/415 |
| 2011/0028249 | A1 * | 2/2011 | Ofori-Ansah | 473/471 |
| 2011/0086732 | A1 * | 4/2011 | Press | 473/471 |
| 2012/0329584 | A1 | 12/2012 | Pinezich et al. | |
| 2013/0178315 | A1 * | 7/2013 | Wright | 473/470 |
| 2014/0179466 | A1 * | 6/2014 | Myers | 473/467 |

* cited by examiner

*Primary Examiner* — Mark Graham
(74) *Attorney, Agent, or Firm* — Thomas J. Germinario

(57) ABSTRACT

A goal-keeping game involves multiple competing goal-keepers. The source sport for the goal-keeping competition can be any sport based on shooting a ball or puck into an opponent's goal, such as soccer, lacrosse (outdoor or indoor), ice hockey or field hockey. Goalies do not compete directly against each other, but rather face non-competing certified players at multiple competition stations. At the competition stations, competing goalies undergo trials with respect to three goal-keeping skill areas: shot saving, passing and dodging. Points are awarded for saved shots, successful passes and effective ball/puck handling.

12 Claims, 15 Drawing Sheets

GOAL-KEEPING GAME

BACKGROUND OF THE INVENTION

The present invention relates to the field of games, sports and athletic competitions, and more particularly to sporting competitions involving goal-keepers.

There are several sports, including soccer, lacrosse (outdoor and indoor), ice hockey and field hockey, in which two teams compete against each other based on points scored by shooting a ball or puck into the opponent's goal. In the conventional rules of these goal-scoring sports, the role of the goal-keeper or "goalie" is principally defensive, i.e., to block or "save" shots from entering the goal. While the defensive skills of the goal-keeper may be important in limiting scoring by the opposing team, the evaluation of goalie skills is obscured because no scoring is assigned to them in conventional play. Moreover, because a goal-keeper is part of a larger team whose offensive and defensive skills differ from those of competing teams, it is difficult to isolate the performance of a goalie from that of his/her team in order to evaluate his/her skill level.

The present invention provides a non-team competitive game in which scoring is based on the defensive skills of the goal-keeper in saving and clearing shots on the goal and handling the ball/puck effectively. While a number of goal tenders compete in the game, the competition is not head-to-head between goalies. Instead, in order to maintain a uniform standard of evaluation, each competing goal-tender faces the same group of selected shooters, executes passes to the same groups of targets, and negotiates the same ball/puck-handling obstacles. Points are awarded to each goalie based on saved shots, effective and speedy ball/puck-handling and possession, and successful clears.

Those goal-keepers scoring the most points advance from the preliminary rounds to playoff rounds and a championship round. In this way, the Guardian Game provides a set of objective standards for evaluating the relative skill levels of goal tenders, so as to be useful to coaches and recruiters.

SUMMARY OF THE INVENTION

The inventive game is played on either an indoor or an outdoor field. The playing field is generally rectangular in shape, with allowance of rounded corners. For an indoor field, the perimeter is enclosed with either netting or hockey boarding. For an outdoor field, the perimeter is marked with 1"-3" wide side and end lines, with additional markers, such as posts or cones, at the corners.

The field is divided up into multiple competition stations, each of which is a minimum of 25 feet wide and 30 feet long, not to exceed 50 yards wide by 100 yards long. Acceptable playing surfaces are based on the sport from which the goal-keeping game is derived, which is hereafter referred to as the "source sport." For example, in a lacrosse-based goal-keeping game, acceptable playing surfaces would include natural grass, astro-turf, field turf, sport court surface, or basketball wood surface, but would exclude ice, concrete or black top.

Each competition station is provided with a goal, which meets the regulations for dimensions and materials applicable to the source sport. In a lacrosse-based goal-keeping game, for example, each goal consists of two posts or pipes perpendicular to the ground, constructed of metal, 6 ft. high, and 6 ft. apart, joined at the top by a cross bar 6 ft. long. The posts and cross bar are a solid color. The posts are 1.5 inches to 2 inches in diameter. There is a line drawn on the ground connecting the two posts called the goal line. The netting must not have holes bigger than 1.5 inches in any direction. The goal is supported by angled pipes that have a flattened cross-section, to prevent a shot from going into the goal, striking a support, and bouncing out again. The netting must be either white or black in color.

As shown in FIG. 1, between adjacent competition stations are substitution areas, where competing goalies must wait their turn to enter and compete in one of the adjoining stations. The substitution areas are beyond the side/end lines and outside the active playing areas of the stations.

The required goalie protective equipment is in accordance with regulations for the source sport. For a lacrosse-based goal-keeping game, for example, the goalie must wear a helmet with face mask and properly secured chinstrap, a separate throat protector, padded gloves, a mouthguard (that covers their entire upper teeth and is molded to their teeth), and a chest protector. Female goalies need to wear thigh and pelvic protection, and male goalies need to wear a jock strap and protective cup. Both female and male goalies are recommended to wear shin guards that contour to the legs. It is also recommended for goalies to wear arm or shoulder guards.

Similarly, goalie sticks must comply with regulations of the source sport. For instance, in a lacrosse-based goal-keeping game, the goalie stick must be made of the following basic materials: composite, metal allow (stick shaft), rubber, wood, gut, leather, fiberglass, nylon, plastic, or another synthetic material. The head of the shaft is triangular in shape. The stick pocket may be longitudinally strung with 6-7 leathers and cross lace string, or may be completely of mesh. The lacrosse stick should not have any protruding parts or edges. The stick's overall length should not be more than 52 inches in length nor less than 35½ inches in length.

The balls or pucks used in the inventive game will also be compliant with standards for the source sports, although there is flexibility to select special balls/pucks for particular playing stations. In a lacrosse-based game, for example, the passing and dodging competition stations will use NOSAE (National Operating Committee of Standards for Athletic Equipment) approved balls, while the saving competition station will use high-bounce balls with lower density than the official lacrosse ball.

In the inventive goal-keeping game, every goalie competes as an individual, without any fellow team members. Each goalie engages in one or more trials at each of the multiple competition stations with non-competing certified players. The certified players at each station are assigned specific functions, such as shooting on the goal defended by the competing goalie or running a pattern to receive a pass from the competing goalie.

An official is assigned to each competition station in order to call fouls on the competing goalies and/or the certified players, to coordinate substitutions of goalies, and to call time outs. station timer/scorer is responsible for keeping track of the amount of time that the goalie is competing in the station. There will be a set time—5-20 minutes or 2 sets of 10 minutes—that the goalie is competing in a given station. No goalie is able to exceed the allotted time, unless the timer or station official issues a foul against a certified player, in which event the goalie is afforded a predetermined extension of time.

The method by which the goal-keeping game is played will now be described. For purposes of this description, the following definitions apply:

"Shot" means a ball or puck aimed at the goal. A ball or puck that travels above or wide of the goal is not considered a shot.

"Initial save" means a save that the goalie makes on a shot, without controlling the ball or puck. For example, if a ball is blocked or hit, but it hits the ground in front of the goalie and rolls into the goal, this will be considered an initial save. Initial saves are counted in double or triple shot stations.

"Full save" means the goalie must save and control the ball.

"Successful pass" means a pass within a stick's length of the receiving player without the receiver slowing down or stopping to receive the ball.

"Catchable area" means a stick length from the receiving player.

There are three types of competition stations, all with the opportunity of the competing goalies to gain points:

1) Saving stations
2) Passing stations
3) Dodging stations

1) Saving Stations a. These are stations where the object is for the goalie to make a save. There will be a set number of shots for the particular station (approximately 15-45 shots). As shown in FIG. 2, every save made will gain the goal-tender a point. Missed shots will not deduct a point. A goalie who saves no shots will receive no points for that station.

b. Scoring for station: A successful score is a tip, trap, or block of a shot on goal. The ball/puck has to be stopped outside of the goal for a period designated by the particular station. For example, if it is a single shot station, the ball/puck has to be saved and come to a stop. For double and triple shot trials, the initial save of the ball/puck is considered a point, and the ball/puck need not come to rest.

2) Passing Stations a. These are stations where the object is for the goalie to complete a successful pass. As shown in FIG. 3, each successful pass will be one point. There will be a set number of attempted passes (approximately 10-15). Missed passing attempts will result in no points. It is not mandatory for the receiving player to catch the ball/puck, but it must be in the catchable area of the receiver to receive a point. Additionally, if the receiver is in route (or running in a particular direction), the ball must be thrown in the direction that the receiver is running The ball cannot be thrown behind—making the runner slow down or stop to receive the ball. This situation would result in 0 points.

3) Dodging Stations a. These are stations which require dodging of obstacles or defenders. As shown in FIG. 4, there is an opportunity to gain approximately 3-5 points per trial. Upon evading all obstacles or defenders, the goal-tender will gain all potential points. Deductions of one point would come from:

1. Dropping the ball while running through the obstacle/defender;
2. Exceeding the required time limit for completing the obstacle course;
3. Brushing, striking, or hitting, one of the obstacles or defenders with the goalie stick;
4. Failing to complete a successful pass, if the obstacle course ends with that requirement.

After all of the competing goalie has completed the competition stations, the top scorers will advance to playoff rounds, after which the top two scorers will advance to a championship round. The following is an example of a championship station for a lacrosse-based goal-keeping game:

The goalie faces four different slot selections. Every second shot there is a rebound thrown in front of their crease. If the rebound comes from the right side of the net, they clamp and pass the ball to a receiver cutting across the goal. If it is thrown on the left side of the goal, the goalie must leave the crease, dodge through four obstacles on the left of the goal, and throw the ball to a receiver. Every full save equals one point and every successful pass equals one point. Running through the obstacle course without dropping the ball or hitting an obstacle with the goalie stick equals one point.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

The present invention is a goal-keeping game preferably involving 25 to 40 goalies in the preliminary round. The source sport for the goal-keeping competition can be any sport based on shooting a ball or puck into an opponent's goal, such as soccer, lacrosse (outdoor or indoor), ice hockey or field hockey. Goalies do not compete directly against each other, but rather face non-competing certified players at multiple competition stations. At the competition stations, competing goalies undergo trials with respect to three goal-keeping skill areas: shot saving, passing and dodging. Points are awarded for saved shots, successful passes and effective ball/puck handling.

Saving stations have three levels of trials:

1. Saves from a stationary shooter,
2. Saves from 1 pass situations, and
3. Saves from 2+ pass situations.

Figure 5:
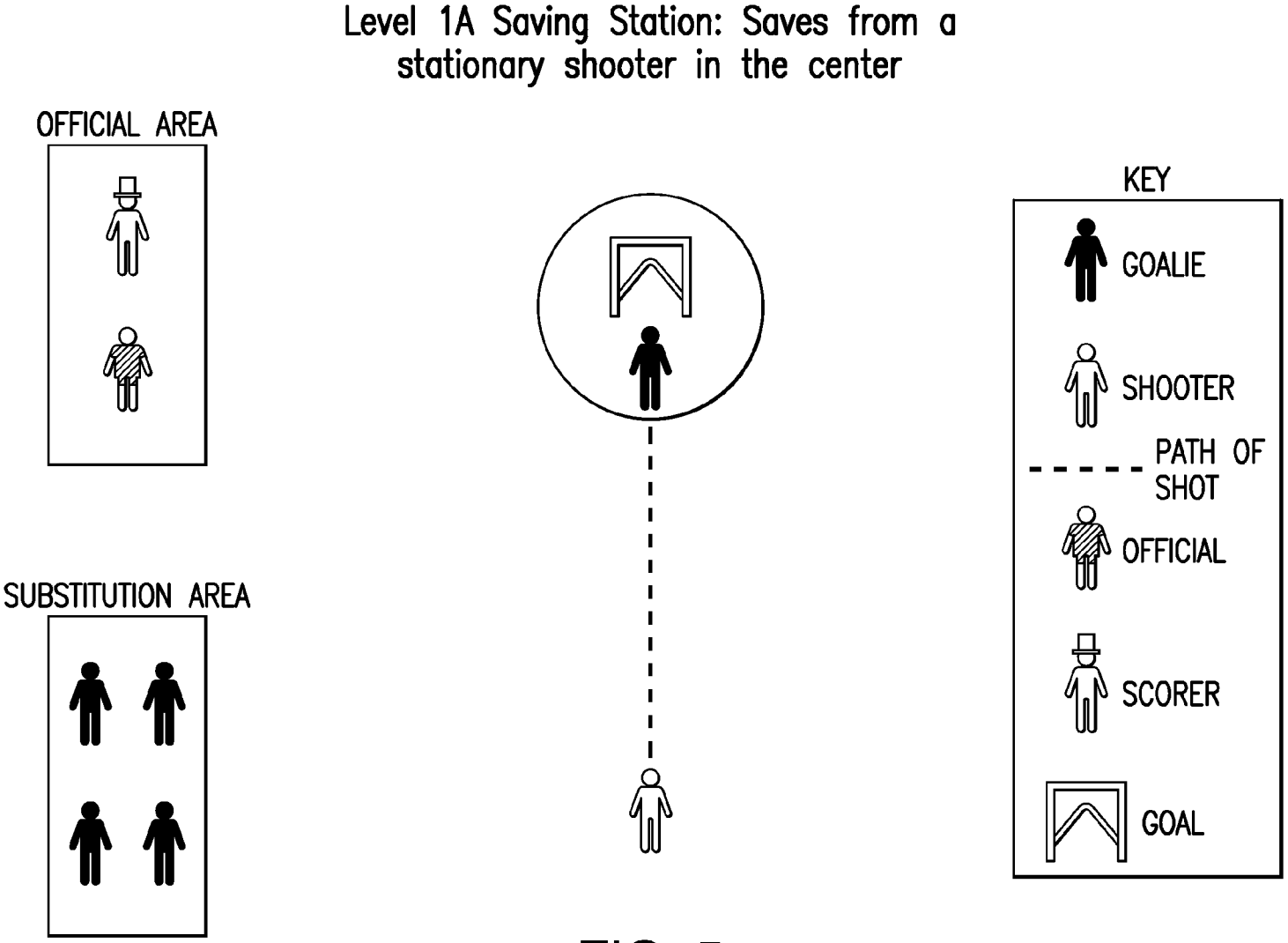
FIG. 5 is a schematic diagram of a Level 1A saving station.

Level 1 saving trials are broken down according to the location of the shooter, with Level 1A in the center, Level 1B to the right of the goalie, and Level 1C to the left. FIG. 5 depicts a Level 1A saving trial, with the certified player shooting at the goal from a center field position. Level 1 saving trials are further classified based on the distance of the shooter from the goal: low ground (less than 3 yards), mid ground (3-7 yards) or far ground (more than 7 yards).

Figure 6A:
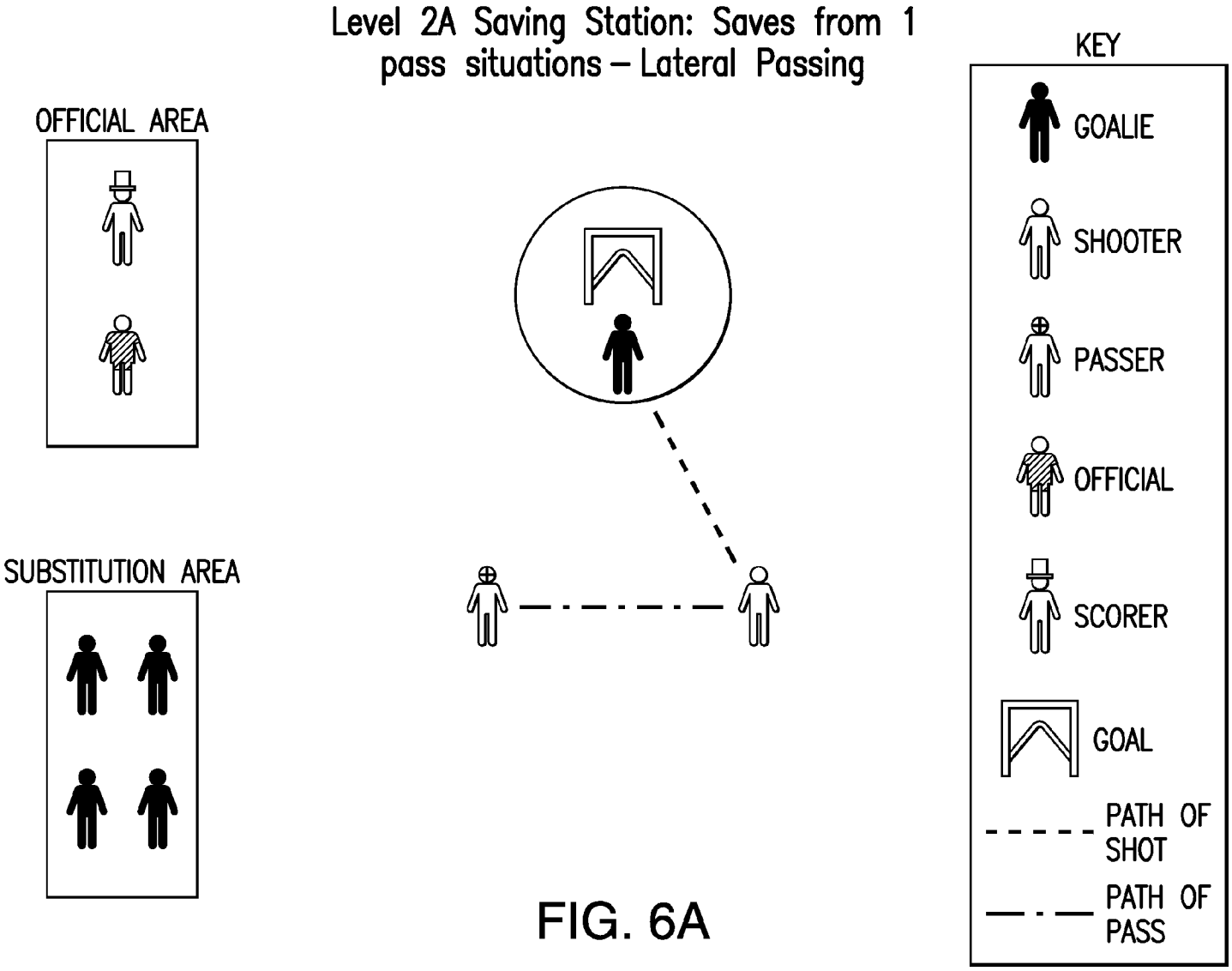
FIG. 6A is a schematic diagram of a Level 2A saving station.
Figure 6B:
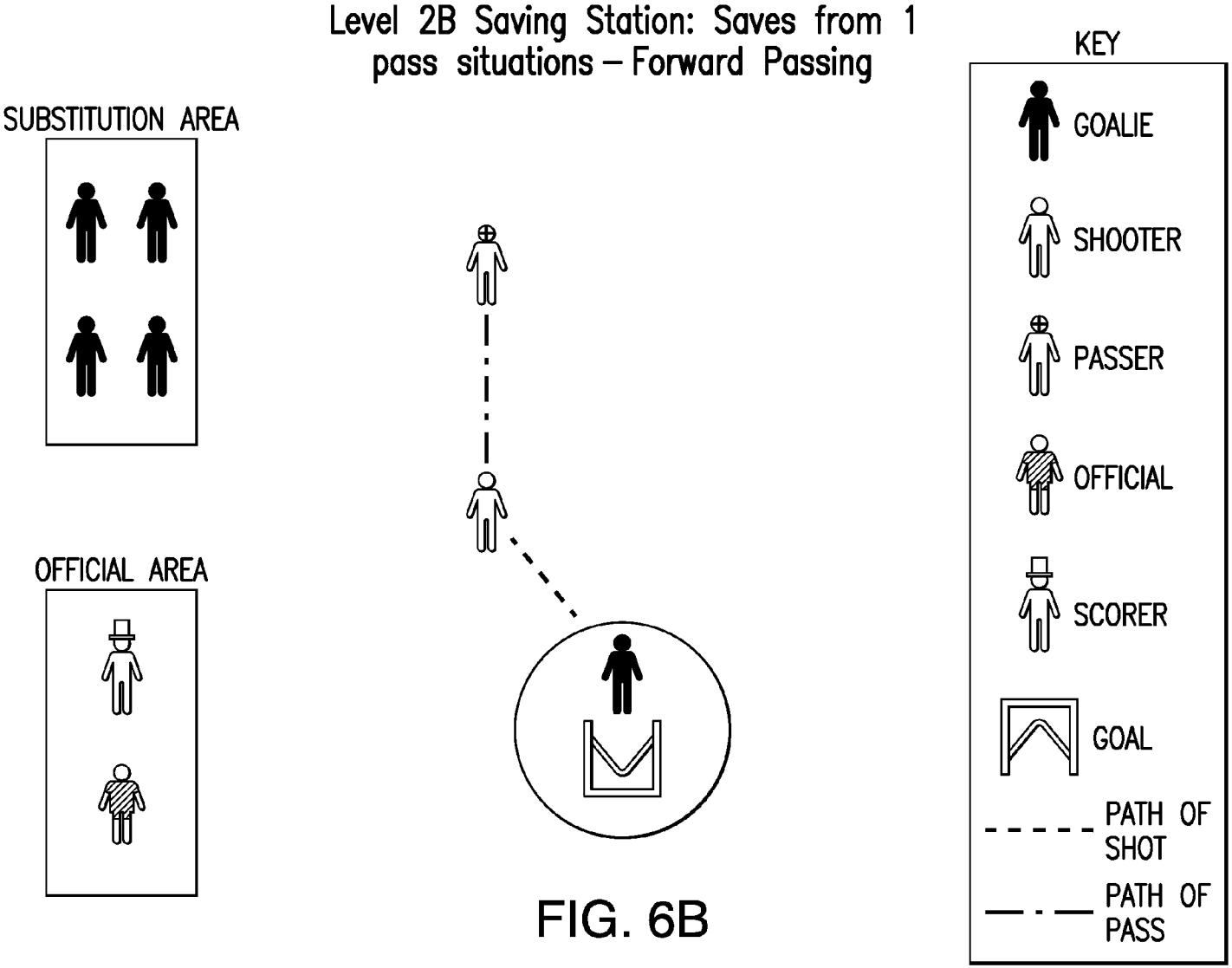
FIG. 6B is a schematic diagram of a Level 2B saving station.

Level 2 saving trials are classified according to the type of pass that precedes the shot on goal. Level 2A involves lateral passing, as depicted in FIG. 6A, Level 2B involves forward passing, as depicted in FIG. 6B, Level 2C involves backward passing, and Level 2D involves diagonal passing. Level 2 saving trials are further classified based on the locations of the passes, for example, from far ground to low ground in Level 2B (forward passing), or from mid ground to mid ground in Level 2A (lateral passing).

Figure 7A:
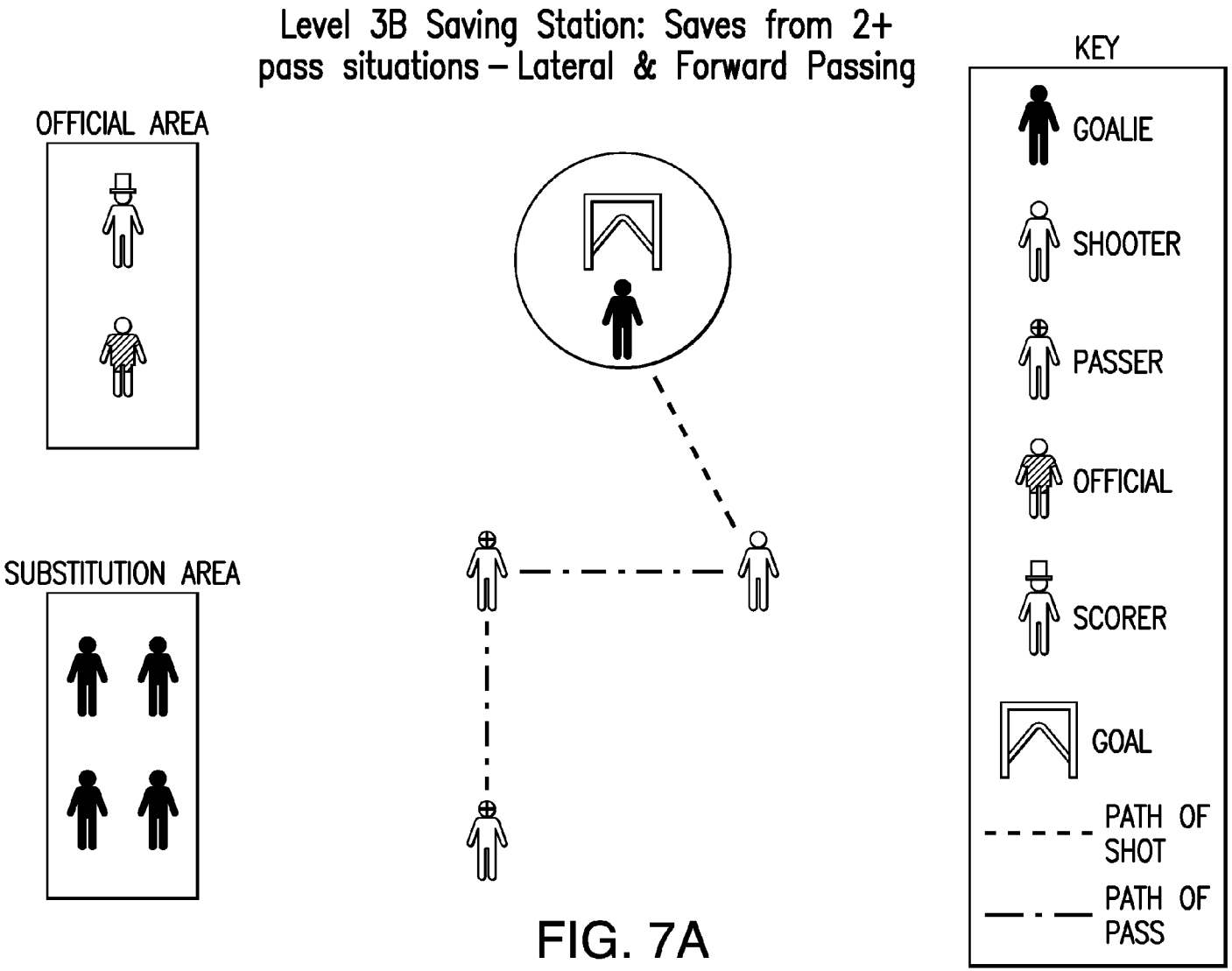
FIG. 7A is a schematic diagram of a Level 3B saving station.
Figure 7B:
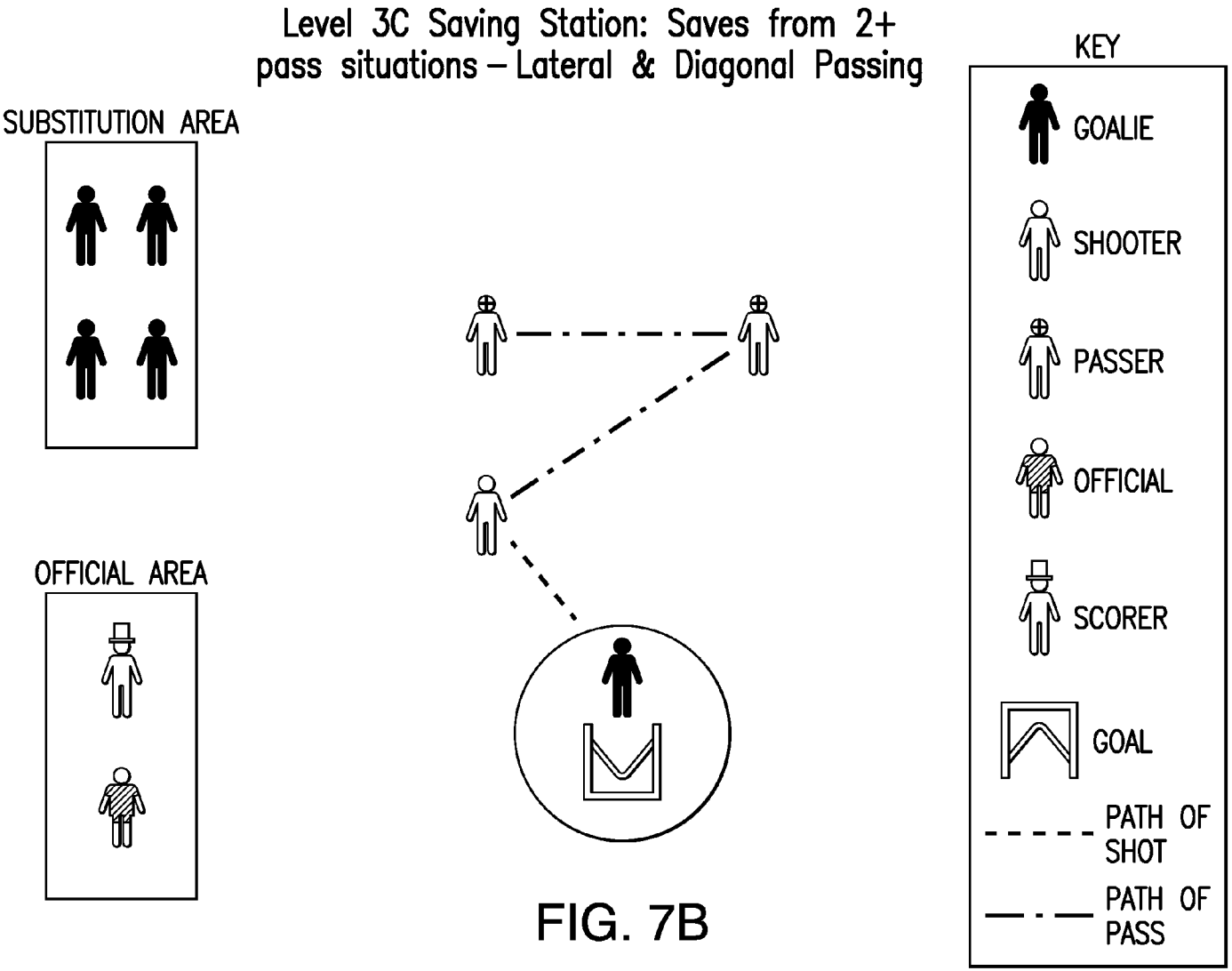
FIG. 7B is a schematic diagram of a Level 3C saving station.

Level 3 saving trials are classified according to the type of passes that precede the shot on goal. Level 3A involves lateral passing only, Level 3B involves lateral and forward passing, as depicted in FIG. 7A, Level 3C involves diagonal and lateral passing, as shown in FIG. 7B, and Level 3D trials involve diagonal and forward passing.

Passing stations have four levels of trials:

1. Passes from a stationary goalie to a stationary receiver,
2. Passes from a stationary goalie to a moving receiver,
3. Passes from a moving goalie to a stationary receiver, and
4. Passes for a moving goalie to a moving receiver.

Figure 8A:
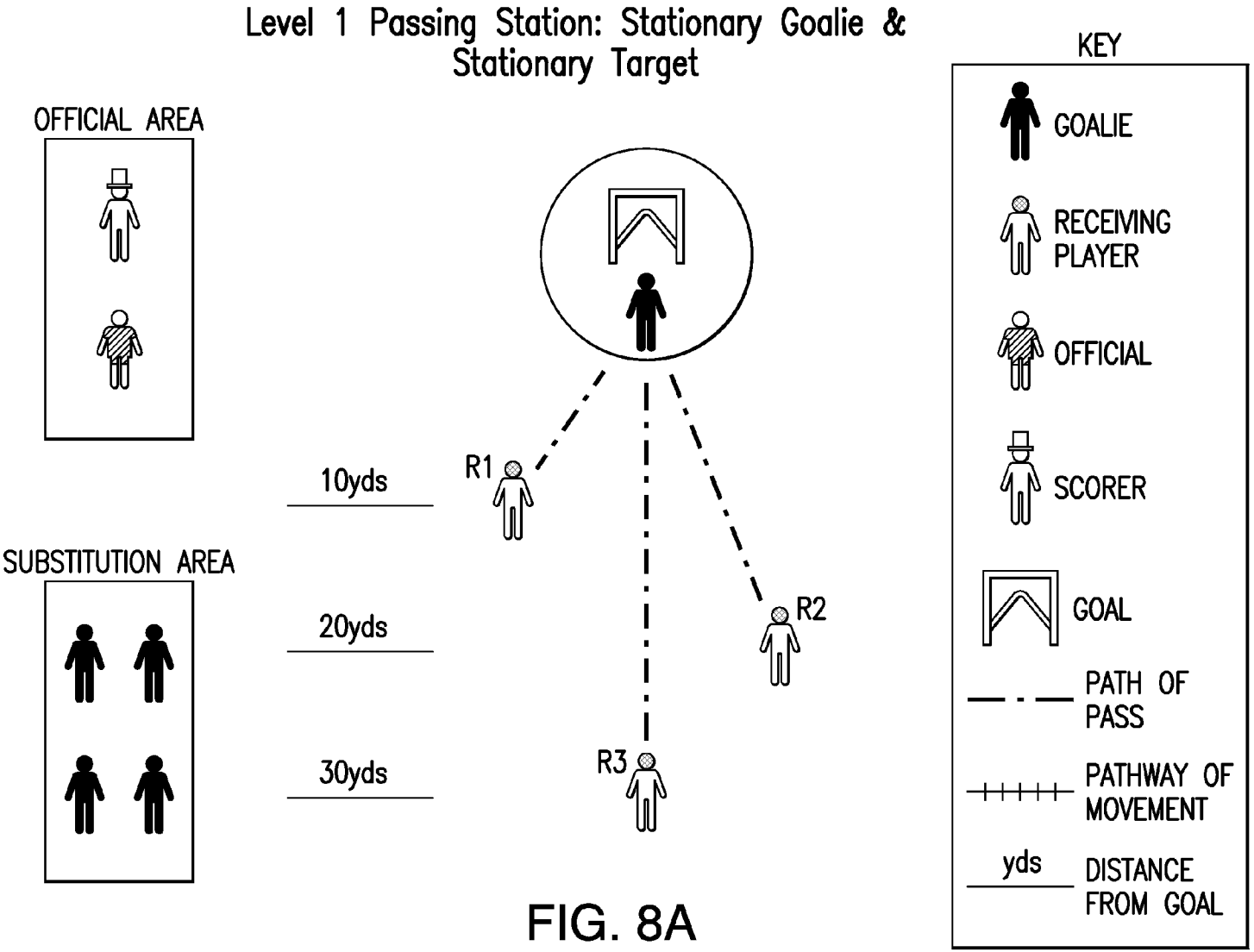
FIG. 8A is a schematic diagram of a Level 1 passing station.

Level 1 passing trials are further classified based on the location of the receiver and the receiver and the receiver's distance from the goal. For example, in FIG. 8A, there is receiver R1 to the right in low ground, receiver R2 to the left in mid ground, and receiver R3 at the center in far ground.

Figure 8B:
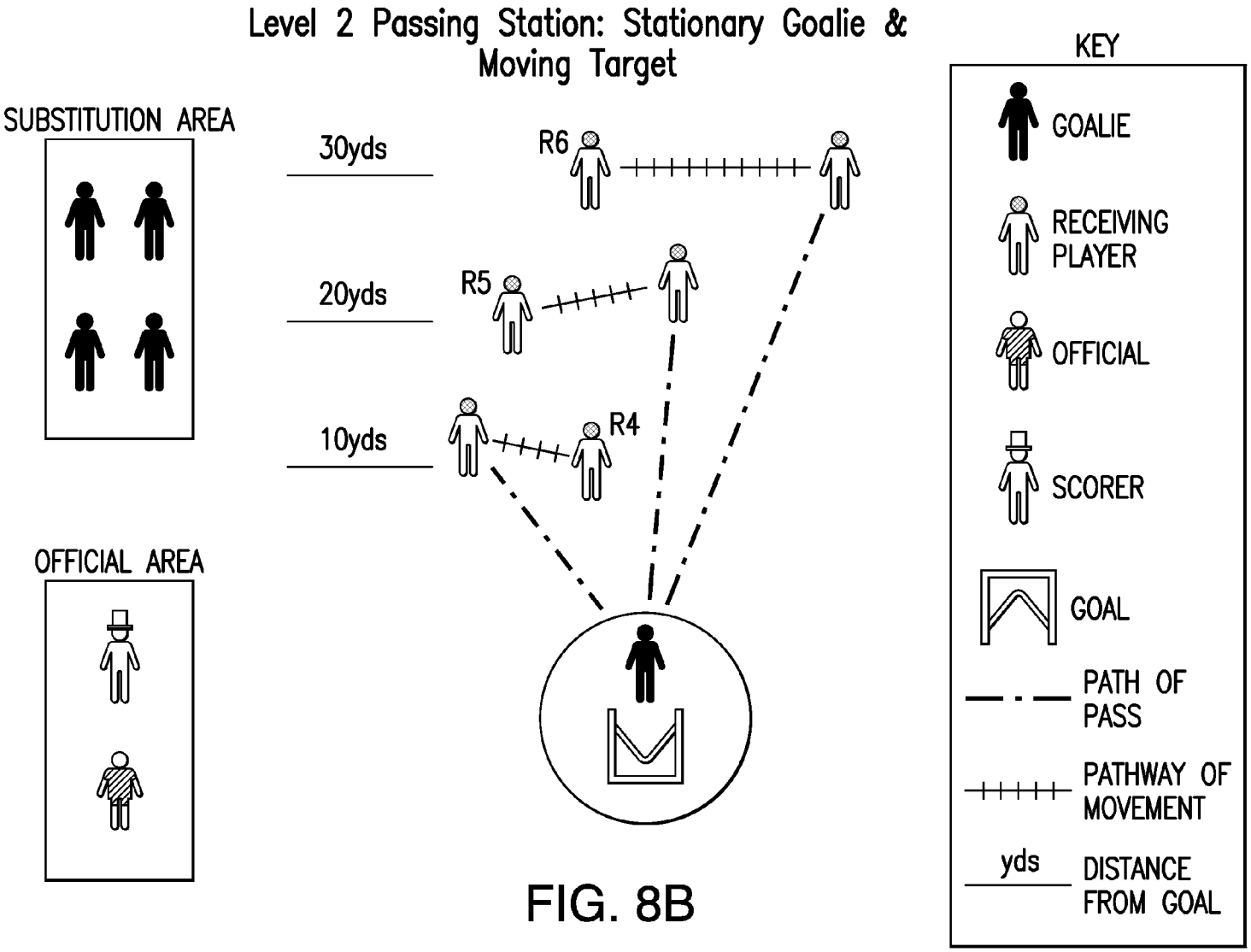
FIG. 8B is a schematic diagram of a Level 2 passing station.

Level 2 passing trials are further classified based on the direction of the receiver's movement and his/her distance from the goal. For example, in FIG. 8B, receiver R4 is in low ground moving laterally to the goalie's left, receiver R5 is in mid ground moving diagonally to the left, and receiver R6 is in far ground moving laterally to the right.

Figure 9A:
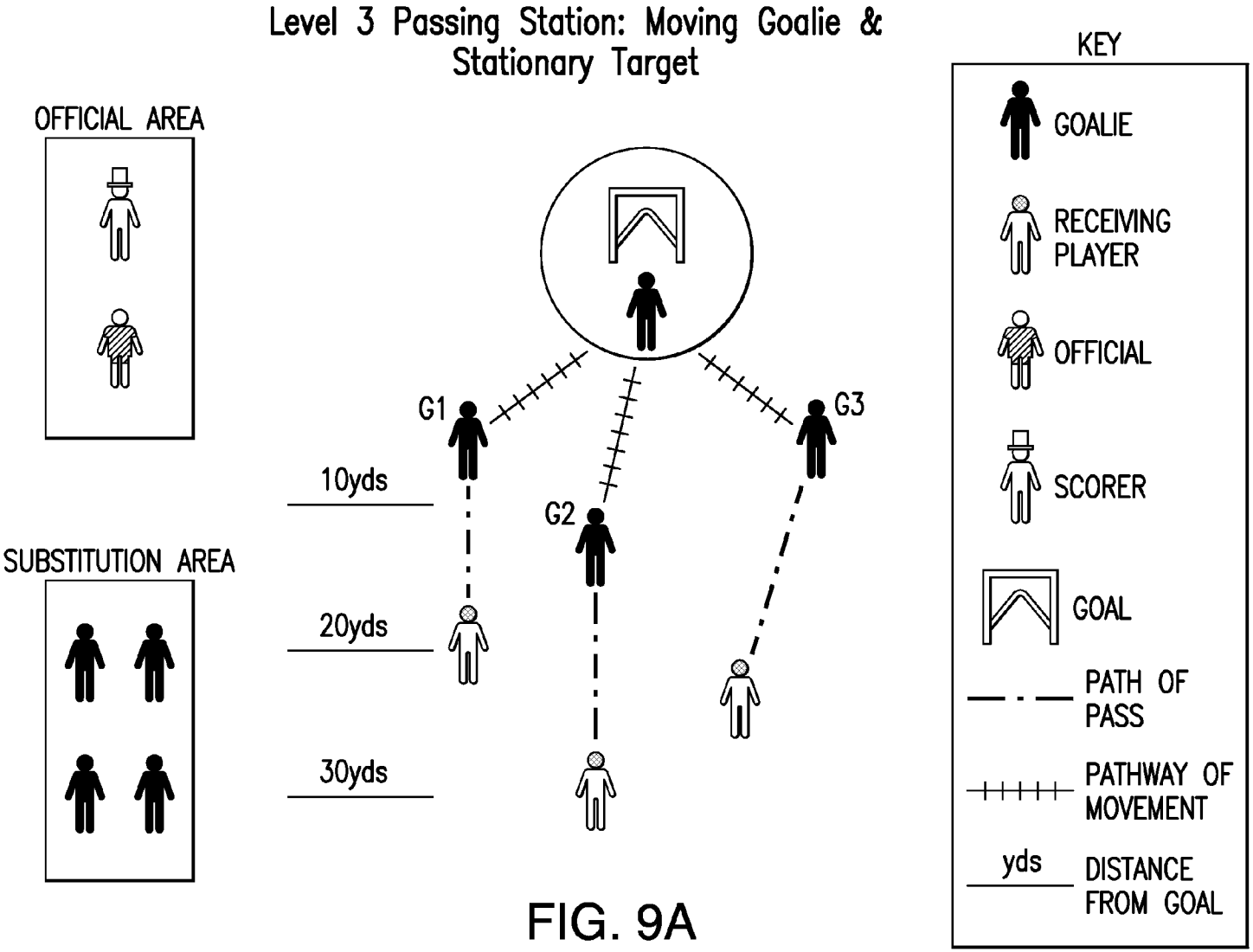
FIG. 9A is a schematic diagram of a Level 3 passing station.

Level 3 passing trials are further classified based on the direction of the goalie's movement in relation to the receiver. In FIG. 9A, goalies G1 and G3 are moving laterally toward the receivers, while goalie G2 is moving diagonally toward the receiver.

Figure 9B:
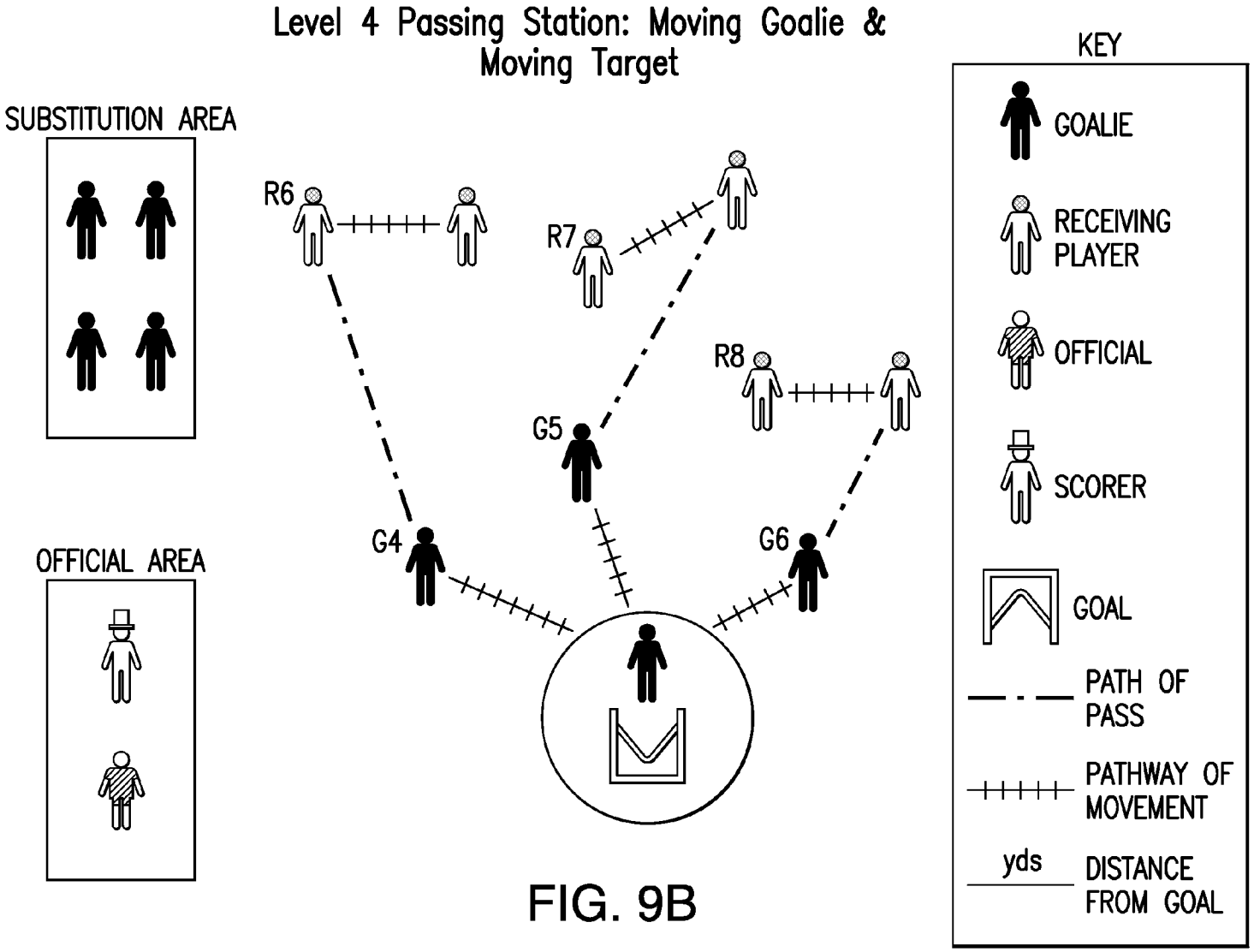
FIG. 9B is a schematic diagram of a Level 4 passing station.

Level 4 passing trials are further classified based on the relative directions of the movements of the goalie and the receiver. In FIG. 9B, goalie G4 receiver R6 are both moving laterally to the left, while goalie G5 and receiver R7 are both moving diagonally away from the goal, and goalie G6 and receiver R8 are both moving laterally to the right.

Figure 1:
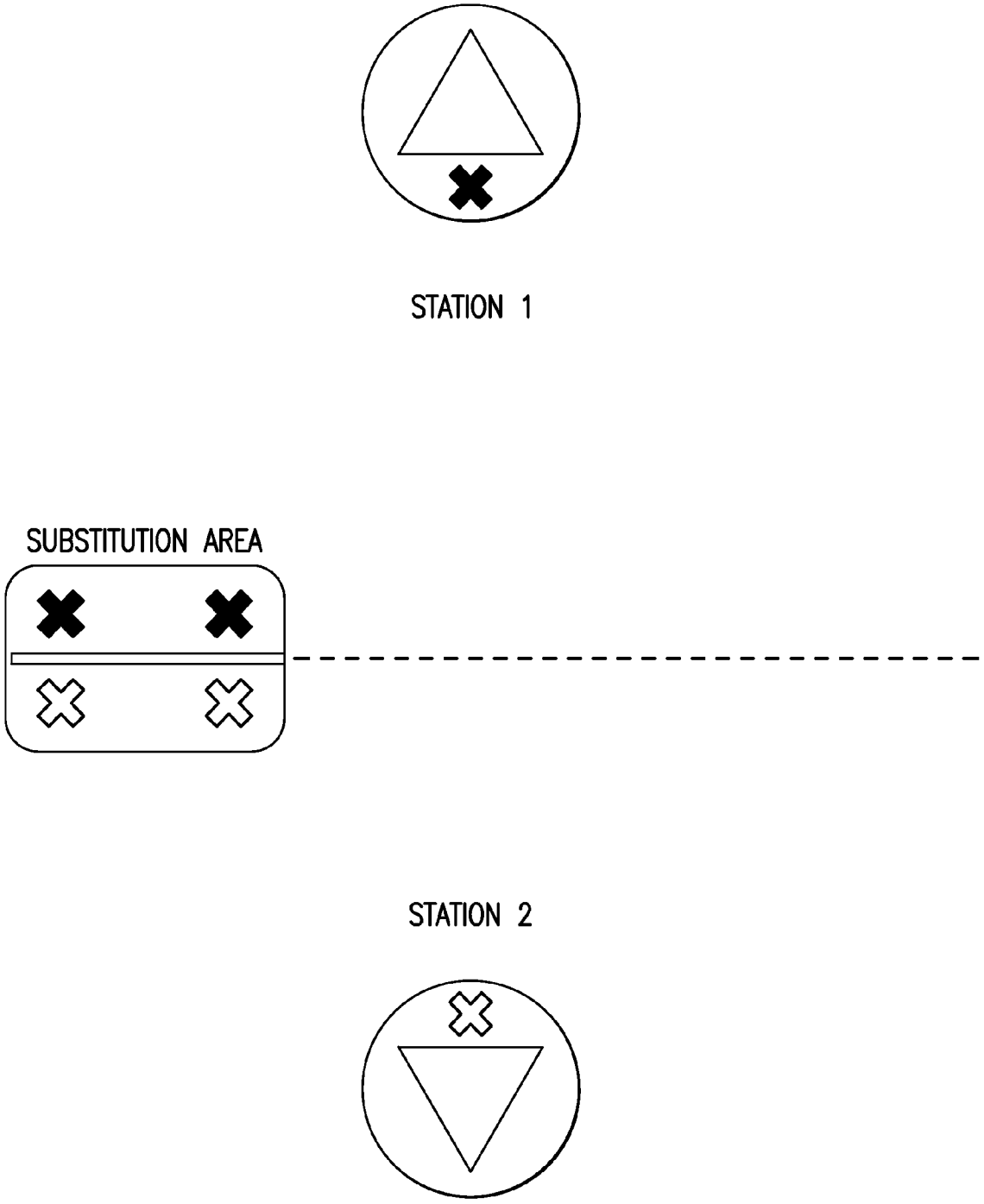
FIG. 1 is a schematic diagram of adjoining competition stations with a substitution area.
Figure 2:
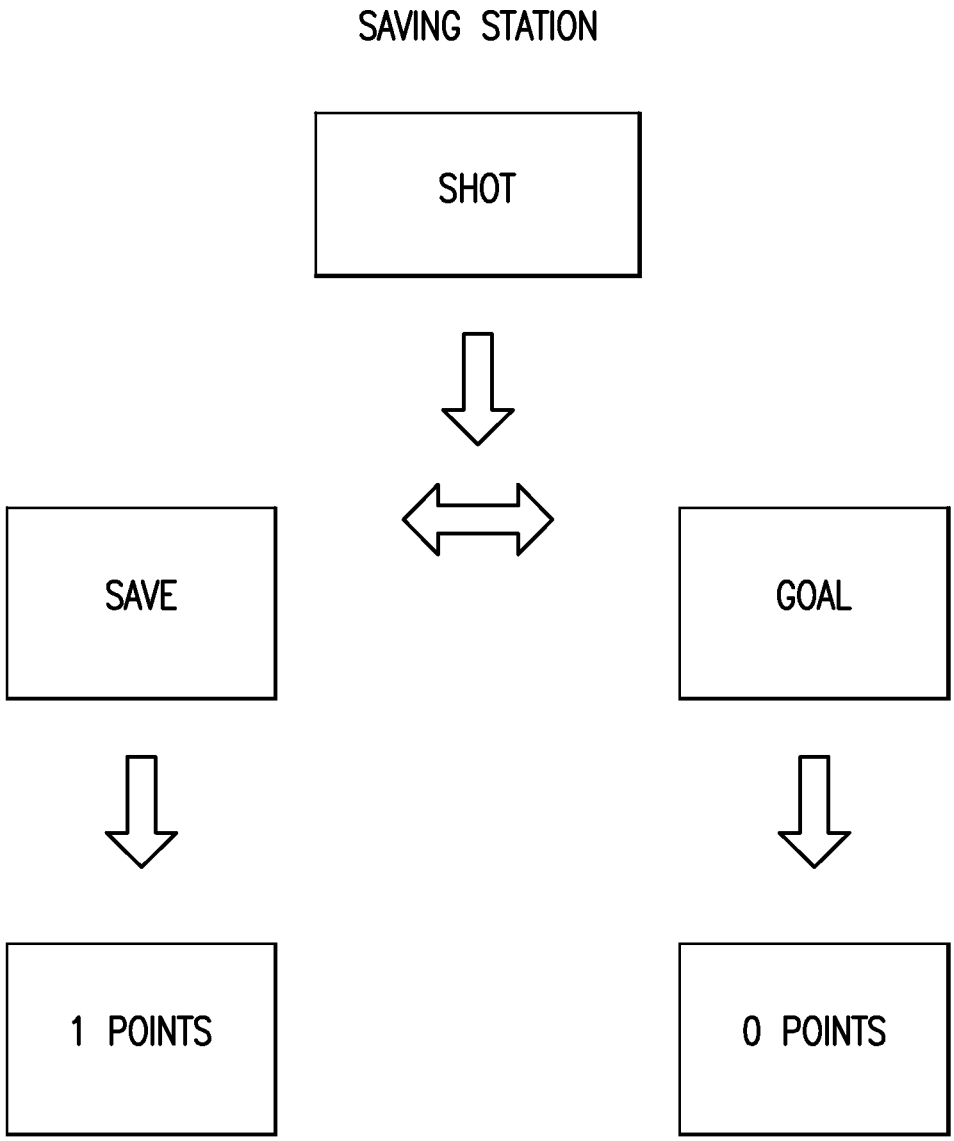
FIG. 2 is a flow chart depicting the scoring at a saving station.
Figure 3:
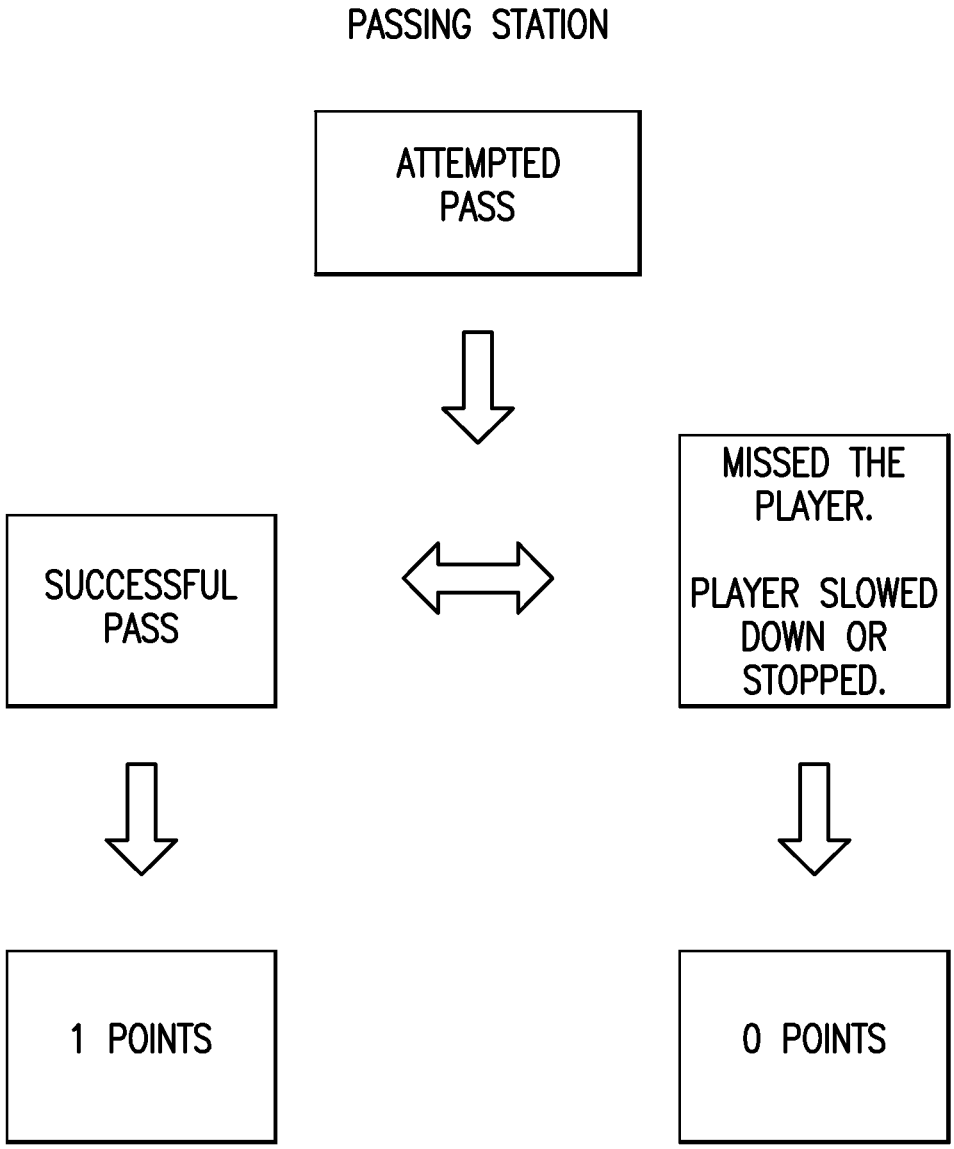
FIG. 3 is a flow chart depicting the scoring at a passing station.
Figure 4:
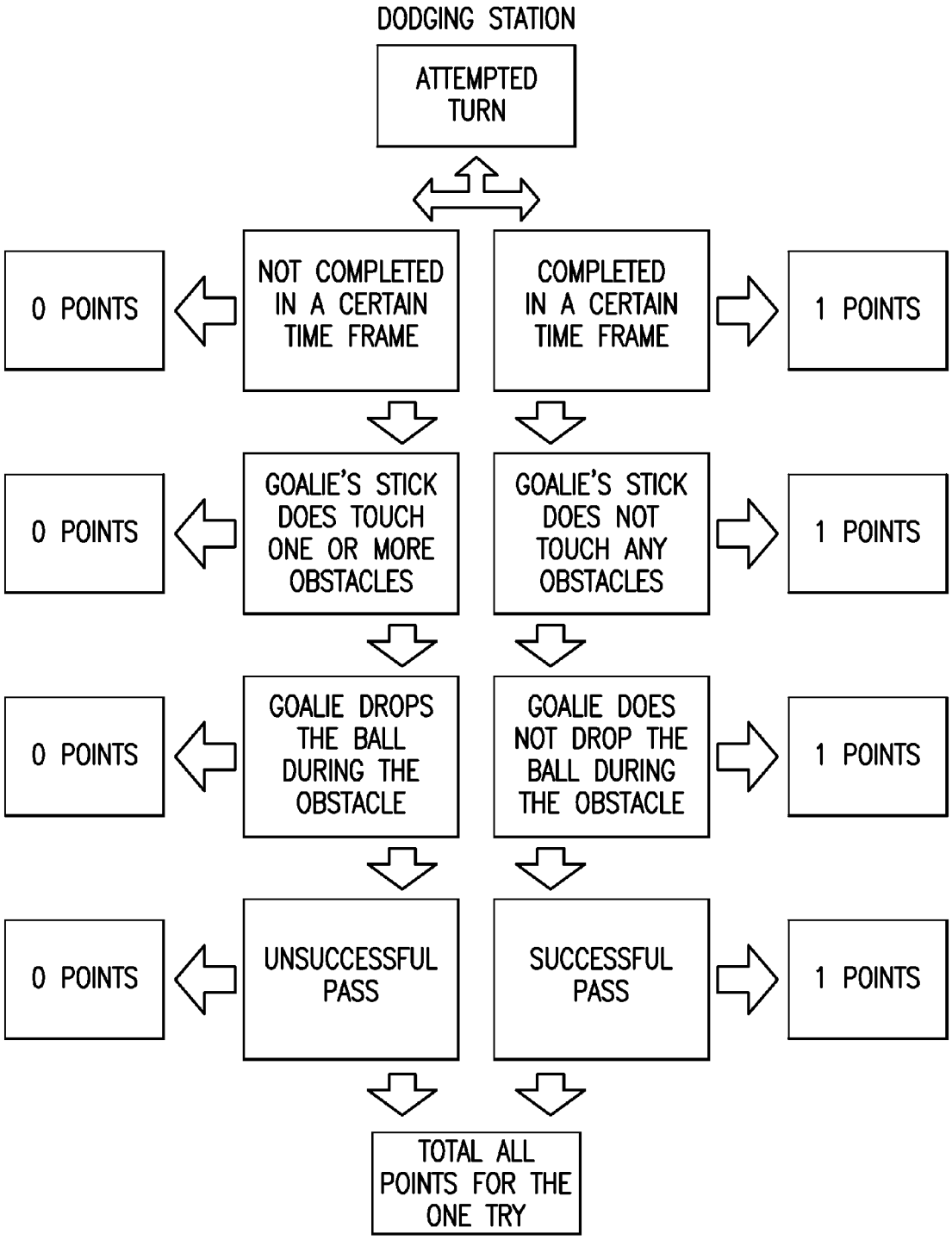
FIG. 4 is a flow chart depicting the scoring at a dodging station.
Figure 10:
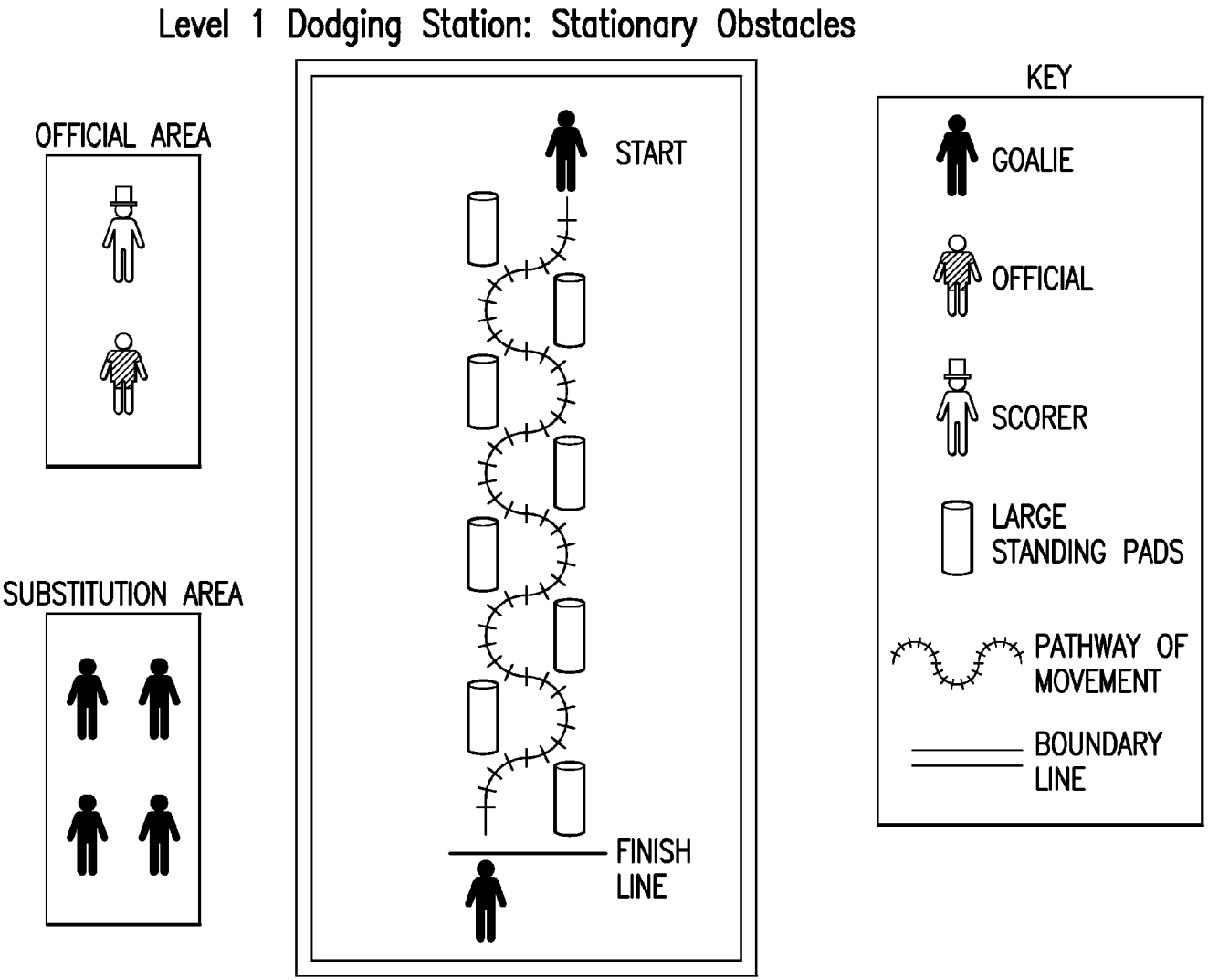
FIG. 10 is a schematic diagram of a Level 1 dodging station.
Figure 11:
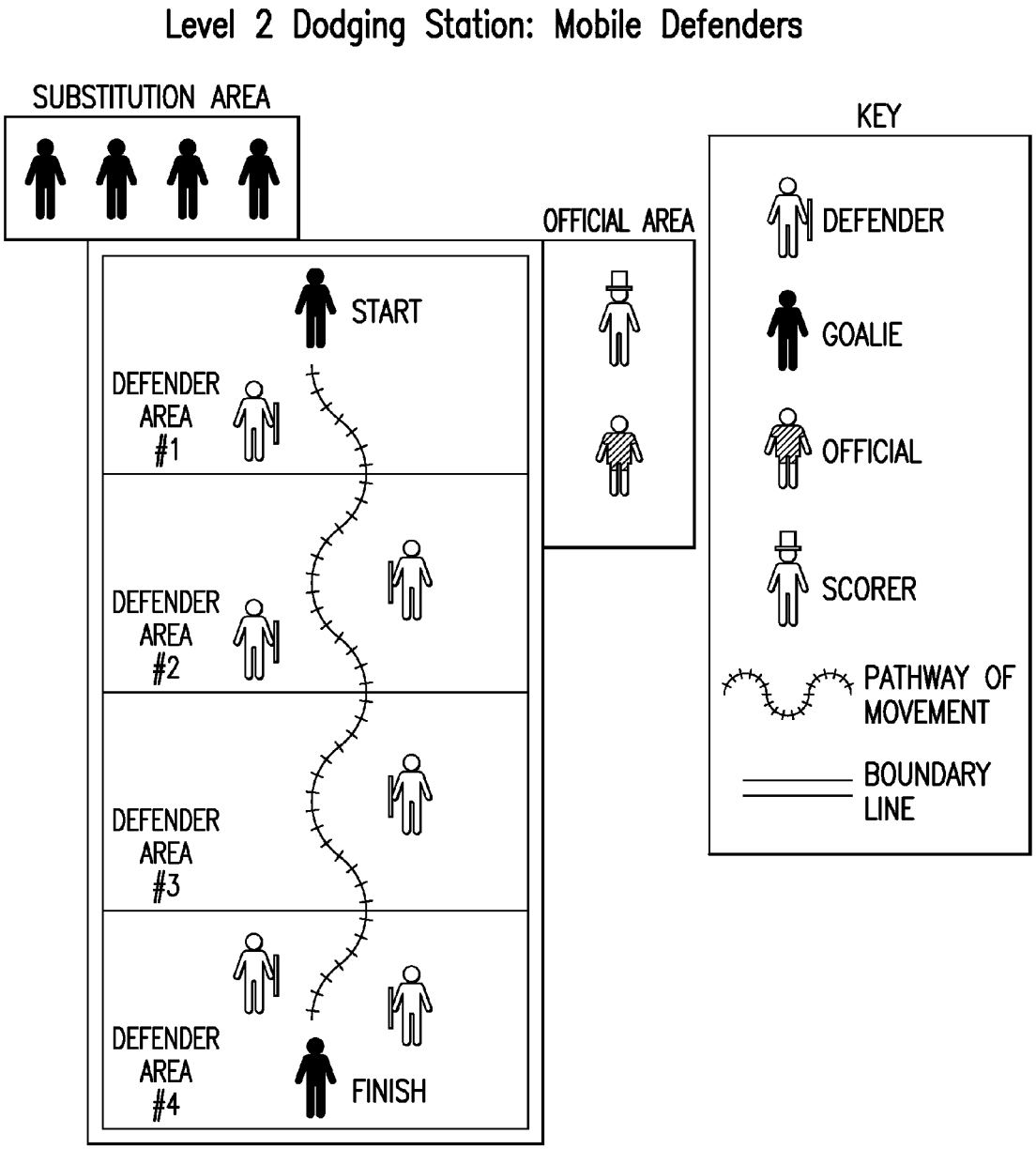
FIG. 11 is a schematic diagram of a Level 2 dodging station.

Dodging stations have two levels of trials:

1. Dodging stationary obstacles, as depicted in FIG. 10, and
2. Dodging certified player defenders, as shown in FIG. 11.

Goalies are awarded points at the dodging stations based on three criteria: (a) time of possession of the ball or puck, with 3 points for maximum time; (b) speed is clearing all obstacles/defenders, with 3 points for minimum time; and (c) avoidance of contact with obstacles/defenders, with 1 point awarded if contact is avoided.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method of playing a goal-keeping game derived from a source sport based on shooting a ball or puck into an opposing goal, the method comprising the following steps:

(a) providing a playing field divided into multiple competition stations, wherein each competition station has a goal which conforms to regulations of the source sport with respect to dimensions and materials;

(b) providing multiple playing balls or pucks which are compliant with the standards of the source sport;

(c) providing multiple competing goalies, wherein each goalie is equipped in accordance with regulations of the source sport;

(d) providing multiple non-competing, non-goalie certified players, wherein each certified player is equipped in accordance with the regulations of the source sport;

(e) providing multiple officials to call fouls, coordinate goalie substitutions, call time outs, keep track of allocated times and keep scores at each competition station;

(f) at one or more competition stations designated as saving stations, conducting one or more saving trials for each goalie, each saving trial comprising a series of shots on the goal by one or more of the certified players acting as shooters, and awarding the goalie one point for each shot that the goalie prevents from entering the goal so as to constitute a save;

(g) at one or more competition stations designated as passing stations, conducting one or more passing trails for each goalie, each passing trial comprising a series of attempted passes from the goalie to one or more of the certified players acting as receivers, and awarding the goalie one point for each successful pass;

(h) at one or more competition stations designated as dodging stations, conducting one or more dodging trials for each goalie, each dodging trial comprising a series of evasive maneuvers by the goalie requiring, within a specified allowed time limit, evasion of multiple stationary obstacles or multiple certified players acting as defenders, and awarding the goalie a designated number of points for completing the evasive maneuvers, with point deductions for exceeding the allowed time limit, for losing control of the ball or puck, and for contact with an obstacle or a defender; and (i) compiling a score for each goalie based on points awarded at each of the competition stations.

2. The method of claim 1, wherein, at one or more of the saving stations, three levels of saving trials are conducted: first level saving trials, comprising saves of shots on the goal from a stationary shooter; second level saving trials, comprising saves of shots on the goal from a shooter to whom the ball or puck has come as a result of one pass from another certified player; and third level saving trials, comprising saves of shots on the goal from a shooter to whom the ball has come as a result of multiple passes among the other certified players.

3. The method of claim 2, wherein some or all of the first level saving trials are further classified according to the distance of the shooter from the goal and the location of the shooter.

4. The method of claim 2, wherein some or all of the second level saving trials are further classified according to the direction of the pass that precedes the shot on the goal and the location of the pass in terms of proximity to the goal.

5. The method of claim 2, wherein some or all of the third level saving trials are further classified according to the types of passes that precede the shot on the goal.

6. The method of claim 1, wherein at one or more of the passing stations, four levels of passing trials are conducted: first level passing trials, comprising passes from a stationary goalie to a stationary receiver; second level passing trials, comprising passes from a stationary goalie to a moving receiver; third level passing trials, comprising passes from a moving goalie to a stationary receiver; and fourth level passing trials, comprising passes from a moving goalie to a moving receiver.

7. The method of claim 6, wherein some or all of the first level passing trials are further classified based on the location of the stationary receiver and the proximity of the stationary receiver to the goal.

8. The method of claim 6, wherein some or all of the second level passing trials are further classified based on the direction of movement of the moving receiver and the proximity of the moving receiver to the goal.

9. The method of claim 6, wherein some or all of the third level passing trials are further classified based on the direction of movement of the moving goalie in relation to the stationary receiver.

10. The method of claim 6, wherein some or all of the fourth level passing trials are further classified based on the relative directions of movements of the moving goalie and the moving receiver.

11. The method of claim 1, wherein at one or more of the dodging stations, two levels of dodging trials are conducted: first level dodging trials, comprising evasive maneuvers by the goalie around multiple stationary obstacles; and second level dodging trials, comprising evasive maneuvers by the goalie around multiple certified players acting as defenders.

12. The method of claim 1, further comprising a preliminary round, a playoff round and a championship round, wherein a group of goalies who achieve the highest scores in the preliminary round advance to the playoff round, and wherein the two goalies who achieve the highest scores in the playoff round advance to the championship round, and wherein the goalie achieving the highest score in the championship round is recognized as a goal-keeping champion.

* * * * *